US006438912B1

(12) United States Patent
Avent

(10) Patent No.: US 6,438,912 B1
(45) Date of Patent: Aug. 27, 2002

(54) SAFETY DOOR AND WINDOW CONSTRUCTION

(75) Inventor: Trevor Adrian Avent, Tullamarine (AU)

(73) Assignees: Gary Raymond Barker; Peter John Unsworth, both of Victoria (AU)

( * ) Notice: Subject to any disclaimer, the term of this patent is extended or adjusted under 35 U.S.C. 154(b) by 0 days.

(21) Appl. No.: 09/501,501

(22) Filed: Feb. 9, 2000

(51) Int. Cl.[7] ..... E06B 1/04

(52) U.S. Cl. ..... 52/207; 52/210; 52/204.62; 52/455; 52/800.13; 52/800.14; 52/204.597; 49/366; 49/368

(58) Field of Search ..... 52/207, 210, 204.597, 52/204.591, 204.62, 455, 456, 800.13, 800.14, 205, 206, 211, 204.51, 208, 204.71, 204.53, 656.2, 656.1, 656.7, 656.4, 656.5, 783.1, 784.1, 204.6, 204.593; 49/366, 368

(56) References Cited

U.S. PATENT DOCUMENTS 4,363,192 A * 12/1982 Soucy ..... 49/453
4,532,743 A * 8/1985 Miller et al. ..... 52/207

* cited by examiner

*Primary Examiner*—Carl D. Friedman
*Assistant Examiner*—Dennis L. Dorsey
(74) *Attorney, Agent, or Firm*—Samuels, Gauthier & Stevens, LLP

(57) ABSTRACT

A door or window unit adapted for use in a sliding or window assembly wherein said door or window unit includes an infill panel or panels (4) housed in a surrounding frame (3) characterised in that said panel is fined substantially flush to a face surface of said frame.

6 Claims, 6 Drawing Sheets

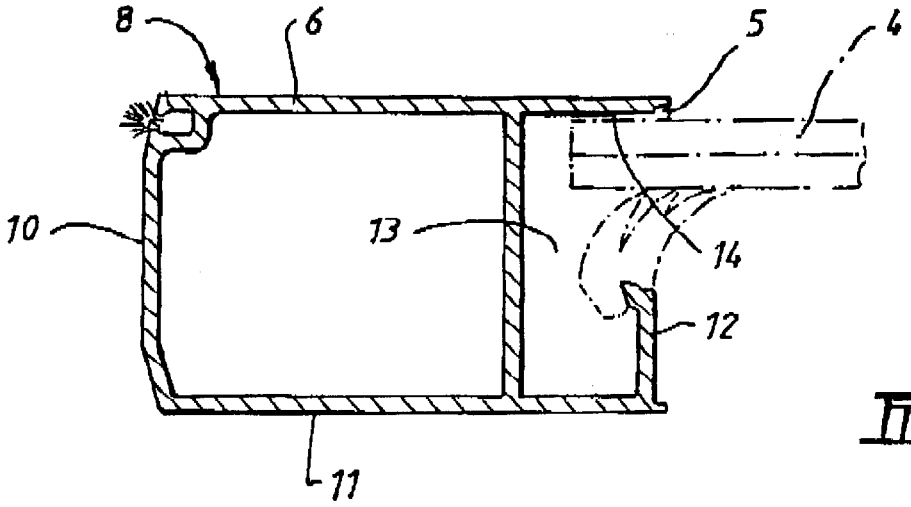
FIG. 4a.
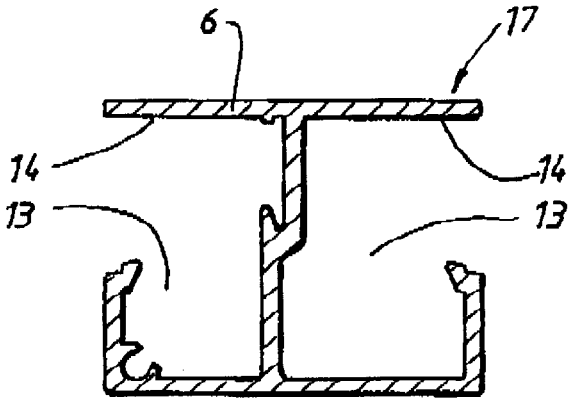
FIG. 4b.
FIG. 4c.
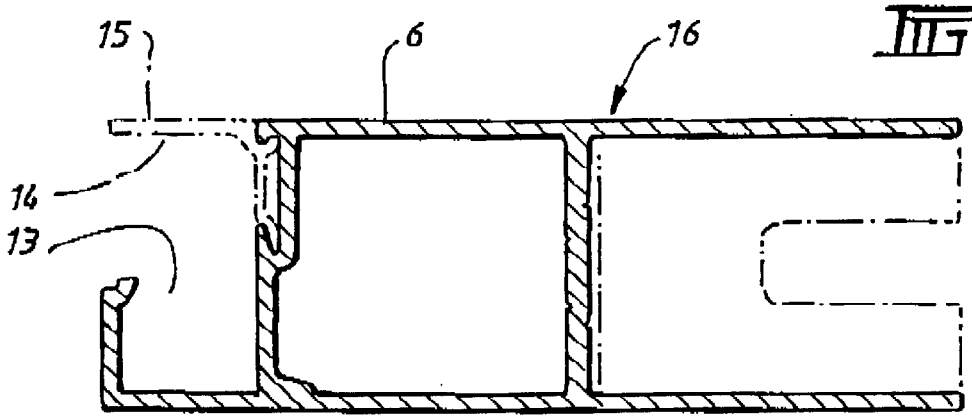

SAFETY DOOR AND WINDOW CONSTRUCTION

INTRODUCTION TO INVENTION

This invention relates to door and window construction particularly in respect of sliding doors and window units made of a framed section where the door or window panel sits within the frame resulting in a non flush sliding unit.

BACKGROUND TO INVENTION

Sliding doors and windows are a popular method of providing an unobtrusive and readily automated opening or closing mechanism.

Such mechanisms generally rely on the availability of a wall cavity into which the door or window can retract when opened to expose an aperture without any residual obstruction by the door or window member.

The automation of doors is common in commercial installations and such sliding doors, often incorporating glass, are frequently constructed out of extruded sections into which is fitted a glass panel or panels. Extruded material allows the precise manufacture of close tolerance framing materials for windows and doors.

Aluminium or steel is a readily extruded material which is commonly used in such commercial sliding door assemblies and provides a reliable manufacturing material capable of great strength and minimal bulk. A key benefit of such extrusion and glass or infill construction is the ability to provide a secure door assembly which can allow maximum use of the infill material either to minimise weight or maximise light transmission in the case of glass infill.

Door suites arc well known which incorporate one or two fixed units and one or two sliding units where the fixed unit is secured to an opening and serves as a jamb for a sliding unit which can slide back and forth past the fixed unit. In this manner, the need for a wall "cavity" is avoided. Such assemblies to date use an extrusion which, in cross section, places the glass infill panels midway through the extrusion thereby exposing a lip between the glass panel and the flush or face surface of the door frame. Such a lip can cause great injury to a user of such a door assembly if the user were to inadvertently place their fingers or any other object against the glass panel of the door unit as it was sliding past the jamb formed by the fixed unit. Similar problems exits when non glass infill panels are used.

In order to address this problem, door assemblies to date must be manufactured such that the sliding door unit or component is arrested before it slides completely past the fixed unit thereby leaving a space between the offending lip and the jamb. However, such an action severely restricts the full opening potential of such assemblies in addition to leaving the edge of such doom exposed to abuse or interception by objects and people passing through the opening.

Sliding doors which could be safely opened fully would be an enormous advantage.

One object of the invention is to provide an improved sliding door or window system.

The term "face surface" shall be read to refer to the exposed surface of a frame member substantially coplanar with an infill panel inserted in said frame.

Accordingly, the invention provides a door or window unit adapted for use in a sliding door or window assembly wherein said door or window unit includes an infill panel or panels housed in a surrounding frame characterised in that said infill panel is fitted substantially flush to a face surface (as hereinbefore defined) of said flame.

The frame is preferably constructed of an extruded member having an elongate retaining channel for housing said infill panel.

The retaining channel preferably incorporates a bearing surface which is adapted to retain said infill panel in abutment such that the distance between said bearing surface and the face surface of said frame is minimal.

The bearing surface may be in the form of an elongate removable bead.

The infill panel may be glass or other material transparent or opaque to visible light.

The invention will be described in greater detail by reference to FIGS. 1 to 6.

FIG. 4 shows details of the frame extrusions.

DETAILED DESCRIPTION

The improved safety door construction of the invention will now be described in greater detail by reference to the above detailed Figures.

Figure 1A:
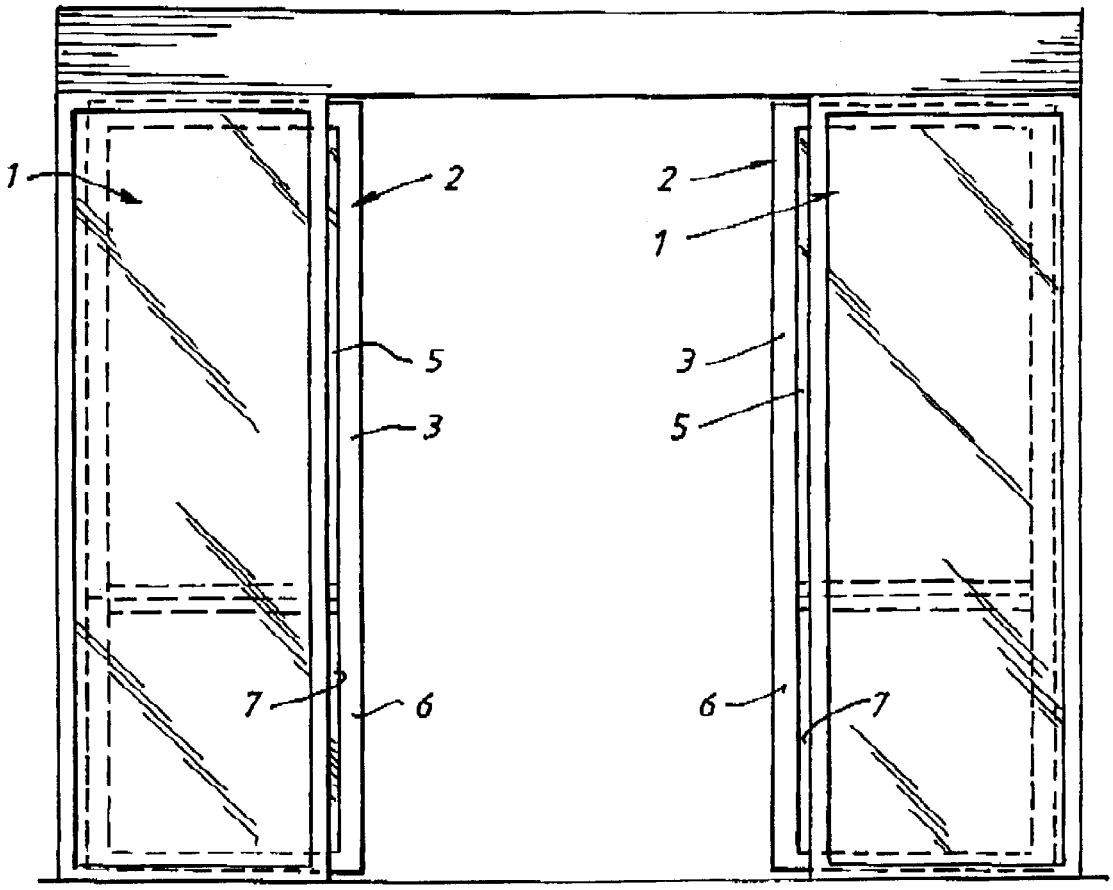
FIG. 1 shows the prior art sliding door assembly in side and plan elevation in an open position.

Firstly by reference to FIG. 1 where the prior art glass sliding door assembly is shown, it can be seen that such an assembly comprises generally two fixed units 1 which are fitted to an aperture in a building or a door way and two sliding units 2 which are fitted generally to the interior of the building such that they can slide backwards and forwards behind the fixed units 1.

Figure 1B:
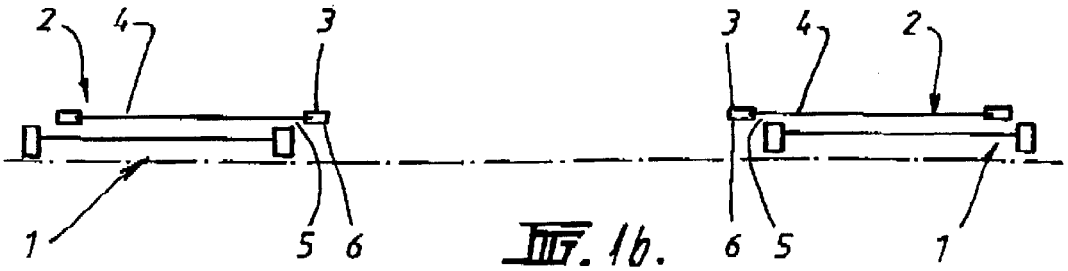

Referring to FIG. 1*b*, the particular problem of the prior art inventions can be readily appreciated where the cross sectional details of the construction of the sliding units can be seen with the vertical frame members 3 of the sliding unit are generally configured to have the light transmitting or glass panel 4 positioned substantially midway across the thickness of the vertical members 3. The provision of the glass panel midway across the thickness of the vertical members of course provides an exposed step or lip 5 between the surface of the glass panel 4 and a face surface 6 of the vertical member 3. The usual method of installing such sliding door assemblies is to have the sliding units moving backwards and forwards in very close proximity to the fixed units 1 and accordingly, the proximity of the sliding unit to the fixed unit provides an opportunity for the lip 5 to create a space 7 into which fingers or other objects can get caught as the sliding unit 2 moves backward and retracts behind the fixed unit 1. In order to avoid the obvious consequences and injuries incurred in such a situation, all prior art sliding door assemblies of the above description must be set up in such a manner that the sliding units are incapable of moving right across the face of the fixed units and are, in fact, made to stop short of such a full opening in order to specifically allow a space 7 of a fixed size to be retained even when the sliding units 2 are fully open. Such a provision thereby prevents any fingers or other projections being caught in the gap provided by space 7. However, such a provision whilst allowing for public safety, of course restricts the available opening of the space through which people and objects can pass. Such a restriction in its own right may not create to many difficulties, however, another serious problem occurs as the remainder of the sliding unit that is left projecting after the sliding panels have "fully opened", provides ample opportunity to catch objects like shopping trolleys and people by as they attempt to traverse the opening. Such altercations with the opened sliding units may result in not only injury to the public but also damage to the sliding units and opening mechanisms etc.

Figure 2A:
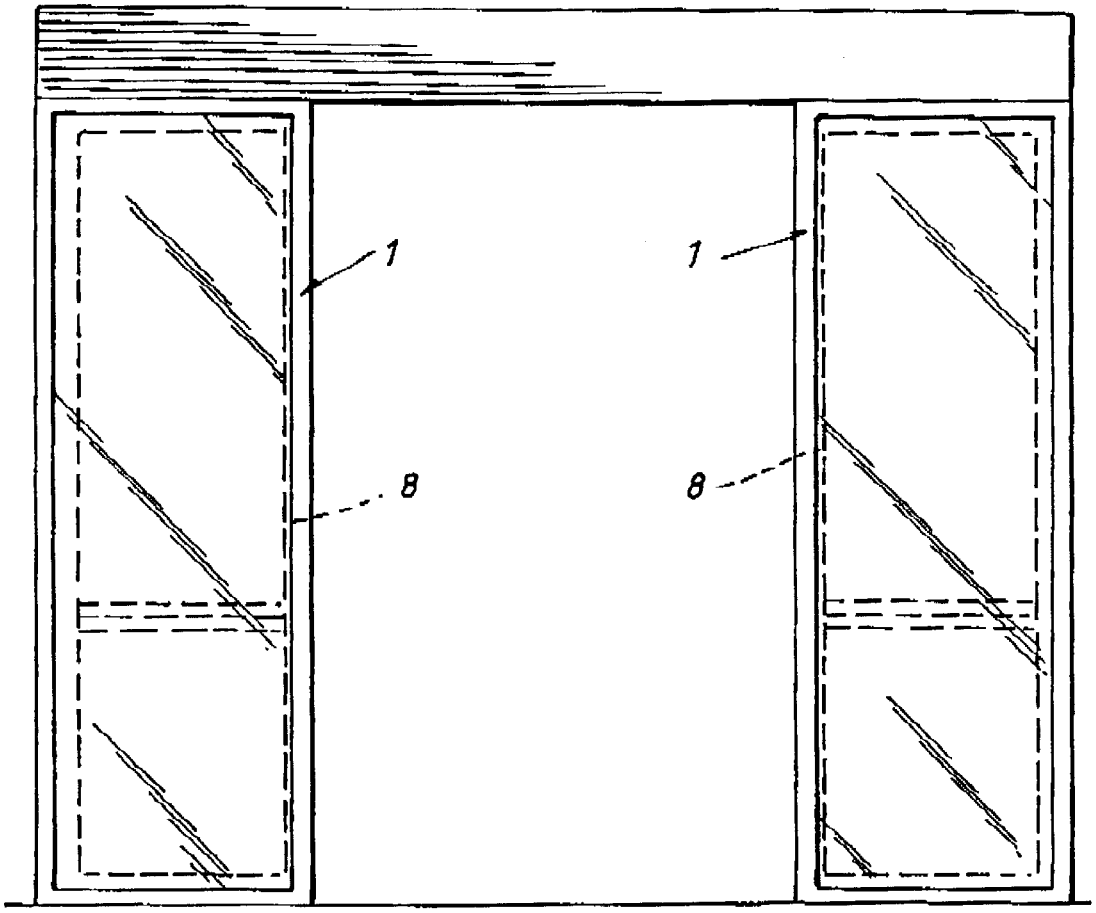
FIG. 2 shows the sliding door assembly of invention in side and plan elevation in an open position.
Figure 2B:
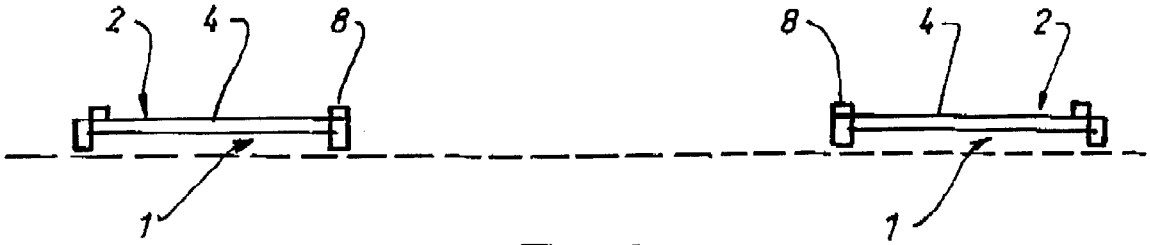
Figure 3A:
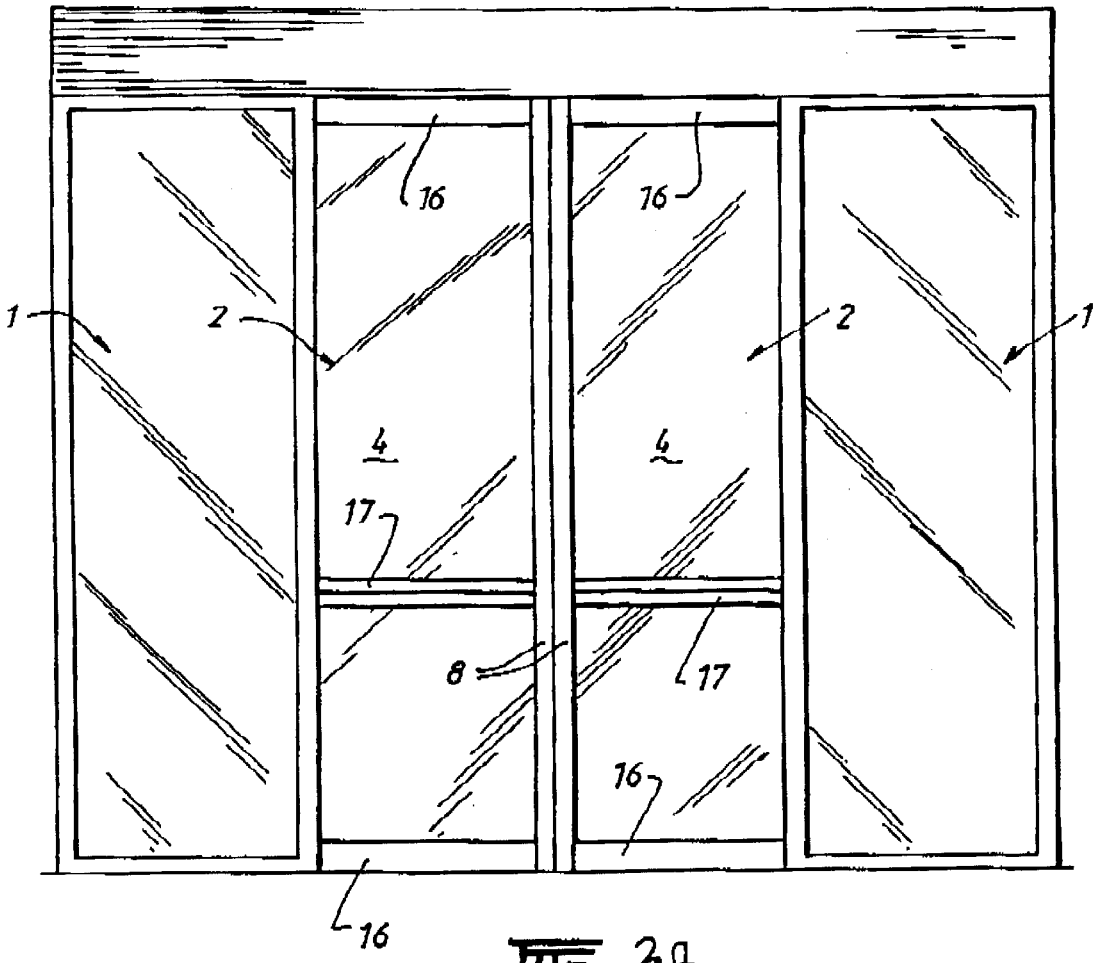
FIG. 3 shows the door assembly of the invention in a closed position.
Figure 3B:
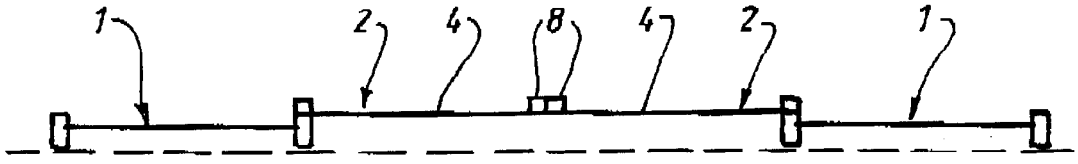

In order to overcome such a disadvantage, the invention has provided for the first time, a particular construction of the sliding units which eliminates or substantially reduces the exposed step on the lip and thereby eliminates all of the aforesaid problems of the prior art assemblies. Referring to FIG. 2*a* and in particular FIG. 2*b*, it can be seen that the invention provides a door, or it could be a window, adapted for use in the sliding door/window assembly with the door or window unit comprising a light transmitting or glass panel 4 which is housed in a surrounding frame 8 such that the glass panel is substantially flush with the face surface of the frame thereby avoiding or rendering negligible the dangerous gap which can catch fingers. FIG. 3*a* and 3*b* show the assembly in the closed position.

Referring now to FIG. 4*a*, the frame extrusion 8 comprises an Aluminium or steel extrusion having a face surface 6 (being that defined surface which slides past the fixed unit 1), an edge surface 10, a rear surface 11 and an inner surface 12. The inner surface is provided with an elongate retaining channel 13 for fitting of the glass panel and in particular, the retaining channel is positioned so as to arrange and allow positioning of the glass panel 4 in an approximate flush arrangement with the face surface 6. Such an arrangement thereby minimises the size of the offending lip 5 which occurs in all prior art doors. Such an arrangement will then allow the sliding units 2 of the sliding door assembly of the invention to fully slide past the fixed units 1 without any risk of fingers or other projections being caught in a gap between the face surface 6 and the sliding panel 4 of the prior art. The particular arrangements of all the extrusions can be seen with further reference to FIGS. 4, b and c where the other components of the frame members are a mid rail shown in FIG. 4*b* and a top and bottom rail shown in FIG. 4*c* which incorporate all the elements of the vertical members 3 with the extra optional provision in the top and bottom rail of a bead 15 which is configured to provide a flush face surface with the face surface 6 of the top or bottom rail member. The retaining channel 13 of all the components incorporates a bearing surface 14 which is adapted to receive and fit the glass panel 4 in close juxtaposition to the face surface 6 in order to minimise the lip 5.

Figure 5:
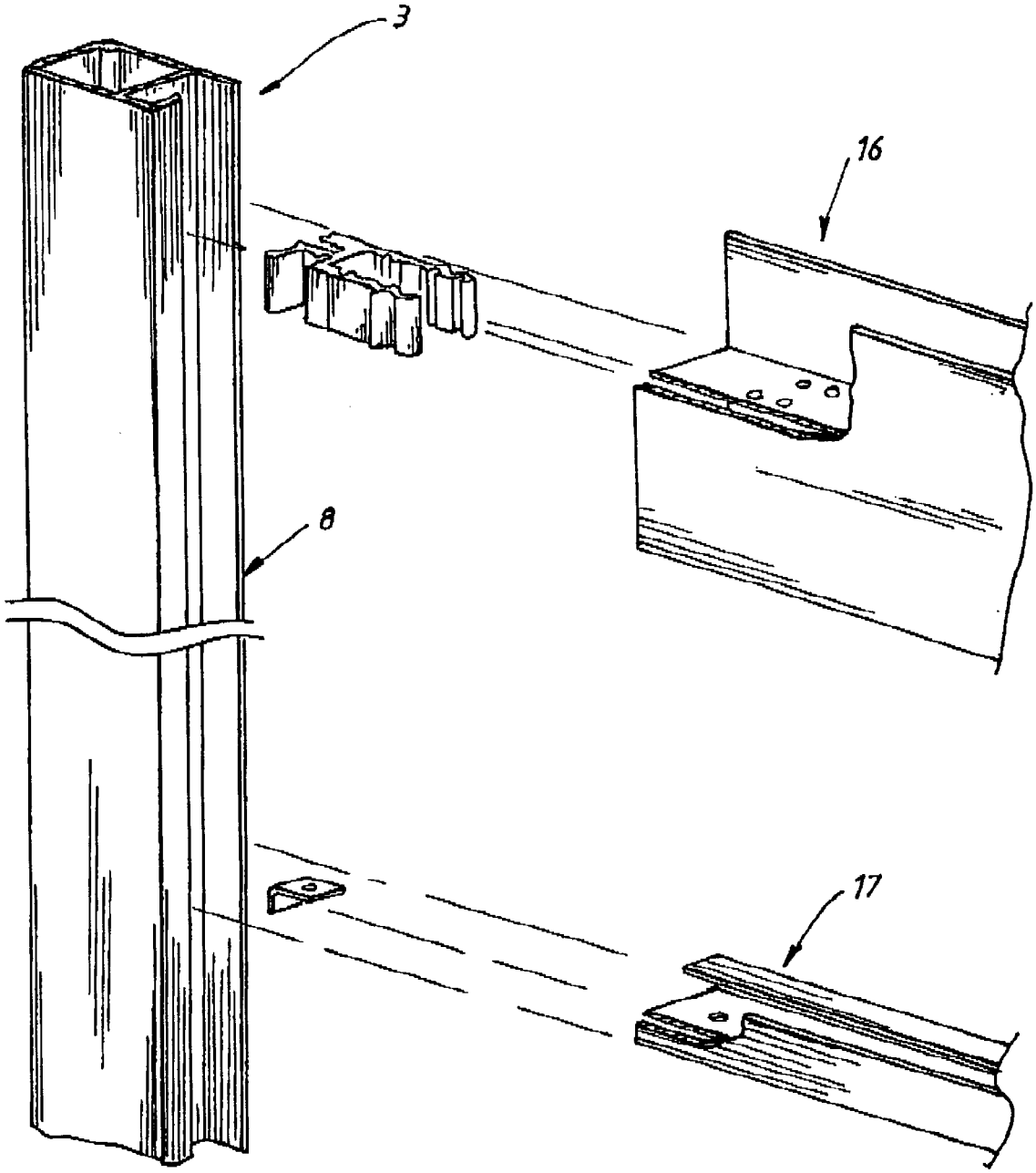
FIG. 5 shows the construction details of the top and side extrusions.
Figure 6:
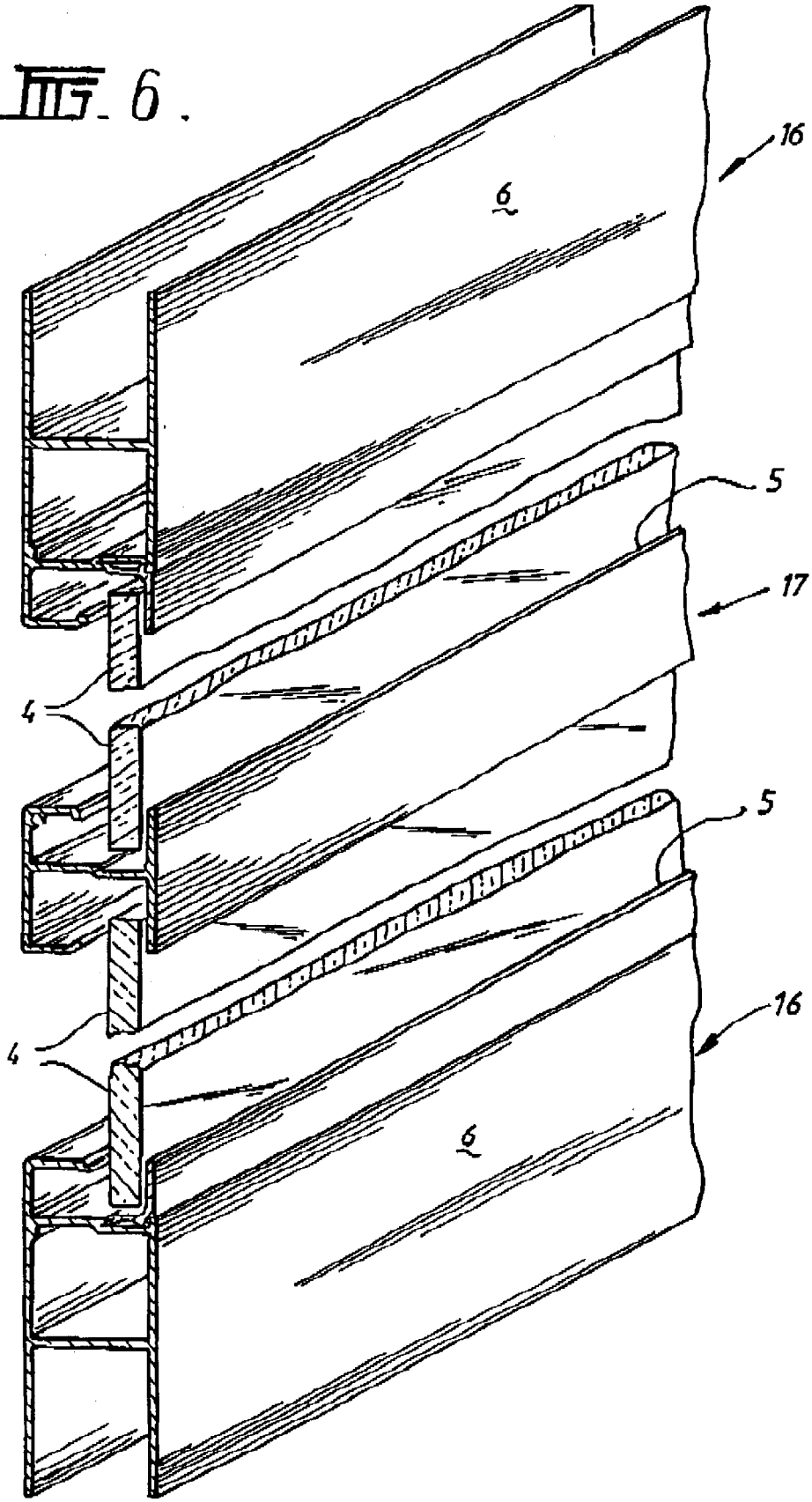
FIG. 6 shows the construction details of the mid rail extrusions.

The particular assembly details of the vertical member 3 and the mid and/or top and bottom rails 16 are shown in FIG. 5 and FIG. 6 which detail the particular juxtaposition of the top and bottom rail 16, the mid rail 17 and their configuration with the glass panels 4. The provision of the flush arrangement between the glass panels 4 and the face surface 6 of all the inter-connecting members of the frame is clearly shown where a minimal lip 5 is retained by the sliding door assembly. The particular arrangements of the invention allow for an extruded member having the suitable strength requirements to safely retain a large glass panel within a frame extraction of the door whilst minimising any unnecessary lips or gaps from the face surface of the whole sliding unit 2. Of course, the details of construction embodying the invention are not limited to the use of extruded frame members and glass panels. Any suitable forming technique can be used to create the framing member of the invention and non transparent panels can be readily applied to the invention.

The advantages of the invention are primarily concerned with the safety of providing sliding glass doors in commercial situations where the sliding glass doors of the invention can be provided in the manner that allows the sliding doors to open completely leaving no exposed edge of the sliding panel available to catch any passers by or shopping trolleys passing through whilst avoiding the potential problems of danger to people operating such doors by eliminating the lip and dangerous space 7 that exists with prior art doors.

However, the inventive aspects of the invention arc applicable to many building situations and not limited to the particular preferred embodiments detailed herein.

What is claimed is:

1. A sliding door assembly comprising at least one fixed unit having a face surface and at least one sliding door unit having a face surface positioned to slide in close proximity to the face surface of the fixed unit, the at least one sliding door unit including an infill panel housed in a surrounding frame, said infill panel being housed in said frame substantially flush to said face surface of said sliding door unit frame, whereby said sliding door unit slides in close proximity to the face surface of the fixed unit without presenting an exposed step or lip between the face surface of the sliding door unit and the face surface of the fixed unit.

2. A unit according to claim 1 wherein said surrounding frame has an elongate retaining channel for housing said infill panel.

3. A unit according to claim 2 wherein said retaining channel has a bearing surface which is adapted to retain said infill panel in abutment such that the distance between said bearing surface and said face surface is minimal.

4. A unit according to claim 3 wherein said bearing surface is an elongate bead.

5. A unit according to claim 4 wherein said frame is formed from at least one extruded section.

6. A unit according to claim 1 wherein said infill panel is transparent to light.

* * * * *